US005280682A

United States Patent [19]

Fussell

[11] Patent Number: 5,280,682

[45] Date of Patent: Jan. 25, 1994

[54] ORNAMENT AND DISPLAY ROTATOR

[75] Inventor: David A. Fussell, Stone Mountain, Ga.

[73] Assignee: Ornamotor, Inc., Duluth, Ga.

[21] Appl. No.: 932,081

[22] Filed: Aug. 19, 1992

[51] Int. Cl.[5] ..... A47F 5/025

[52] U.S. Cl. ..... 40/409; 362/123; 362/806; 428/19

[58] Field of Search ..... 40/409; 108/20; 136/254; 211/1.5, 163; 362/35, 122, 123, 194, 269, 362, 365, 806; 428/18, 19; 318/17, 558

[56] References Cited

U.S. PATENT DOCUMENTS 3,766,376 10/1973 Sadacca et al. .
4,232,304 11/1980 Durley, IV .
4,890,008 12/1989 Chu ..... 307/149
4,980,608 12/1990 Morrison ..... 315/185 S
4,989,120 1/1991 Davis et al. ..... 362/35
4,989,124 1/1991 Shappell ..... 362/183
5,043,193 8/1991 Ueda ..... 428/18
5,065,289 11/1991 Teng ..... 362/101
5,092,065 3/1992 Teng ..... 40/410
5,104,608 4/1992 Pickering ..... 362/32
5,109,989 5/1992 Kremmin et al. ..... 211/1.55

*Primary Examiner*—Bentsu Ro
*Attorney, Agent, or Firm*—James A. Hinkle

[57] ABSTRACT

An ornament and display rotator has a reduction geared rotational shaft (3) of a miniature motor (2) extended from an apex (4) of a cone-shaped housing (1). Ornament and display attachment means (14, 17, 18, 23, 24, 51) adaptable to a wide variety of ornaments (6) and other objects for rotation are provided on the rotational shaft (3). Linear bearing (25, 29) means also is provided as needed for vertical load bearing relationship between the apex (4) of the cone (1) and the rotational shaft (3). Adaptable means for attachment of the base (9) of the cone-shaped housing (1) to a wide variety of objects and structures is provided. The cone-shaped housing (1) is adaptable to stored energy motors (47) and gas powered motors (42) in addition to small electrical motors (2).

31 Claims, 8 Drawing Sheets

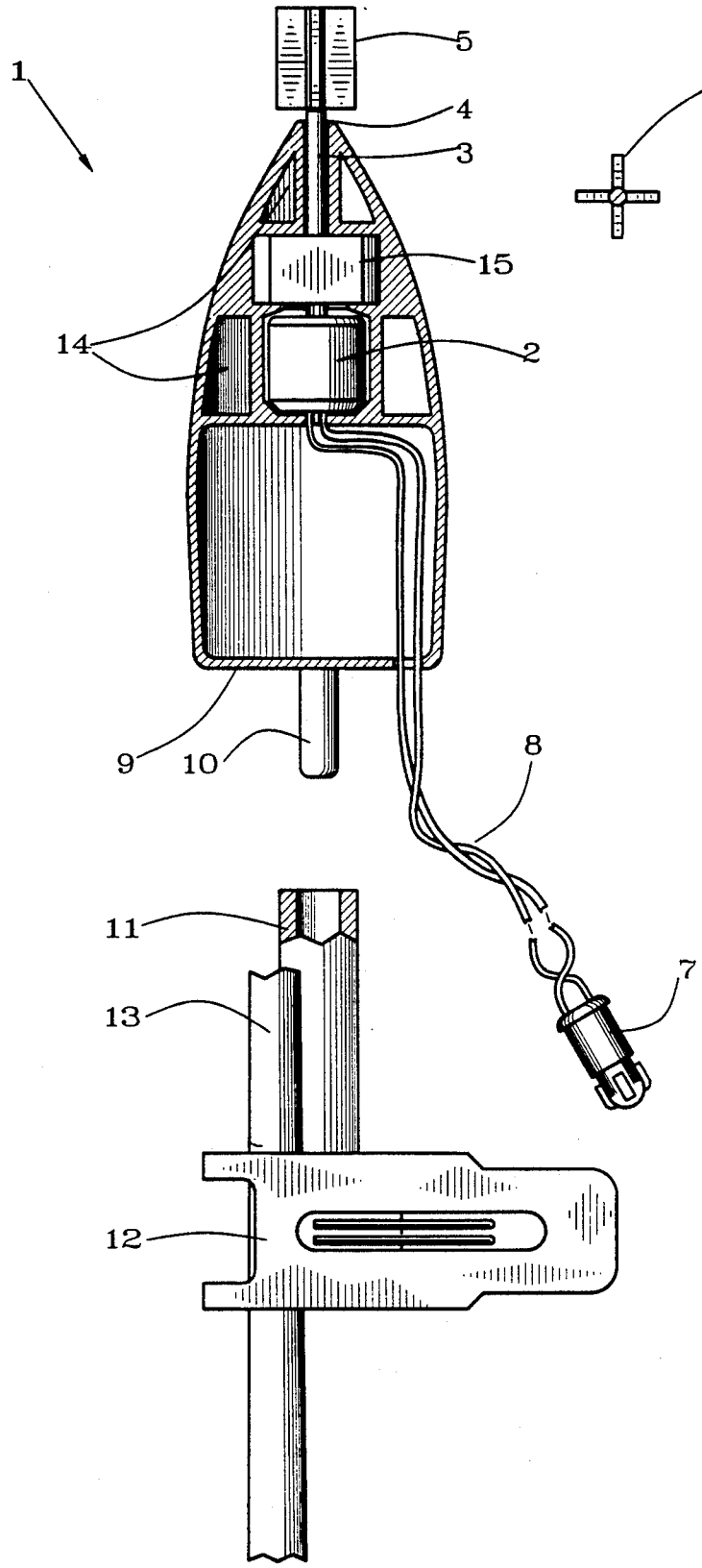
FIG.1
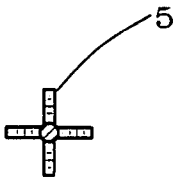
FIG.2
FIG.3

FIG.21
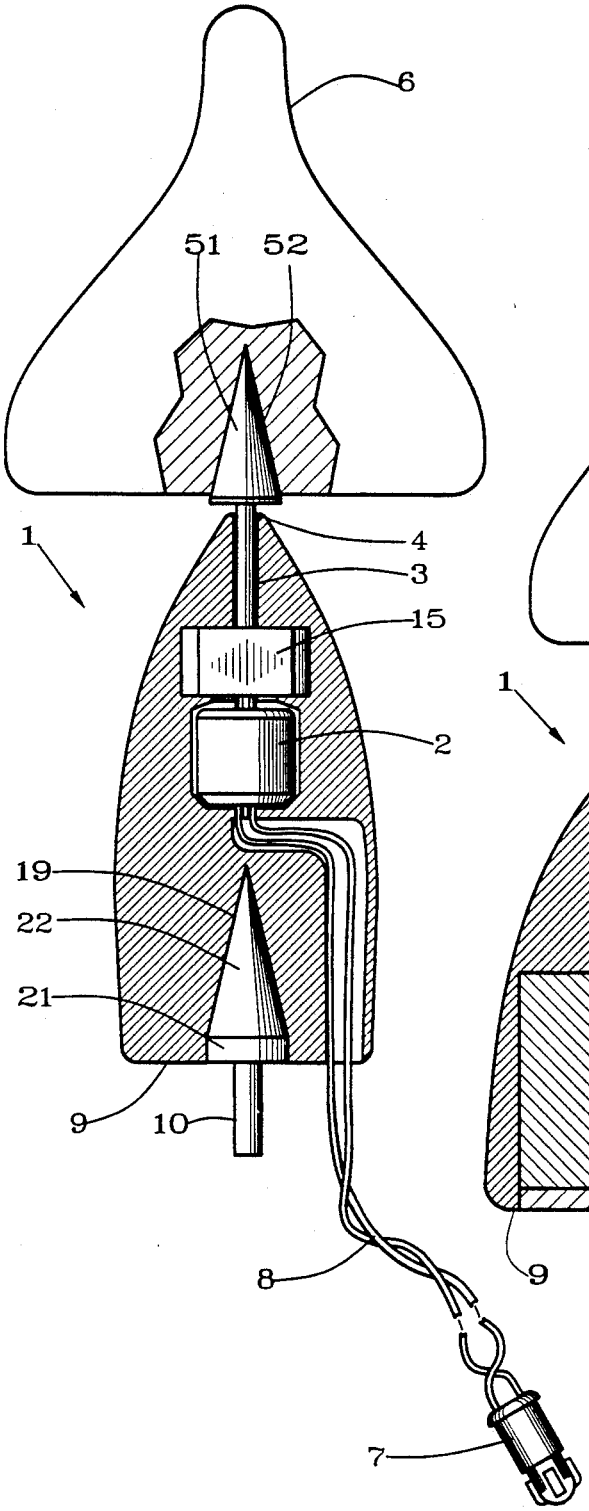
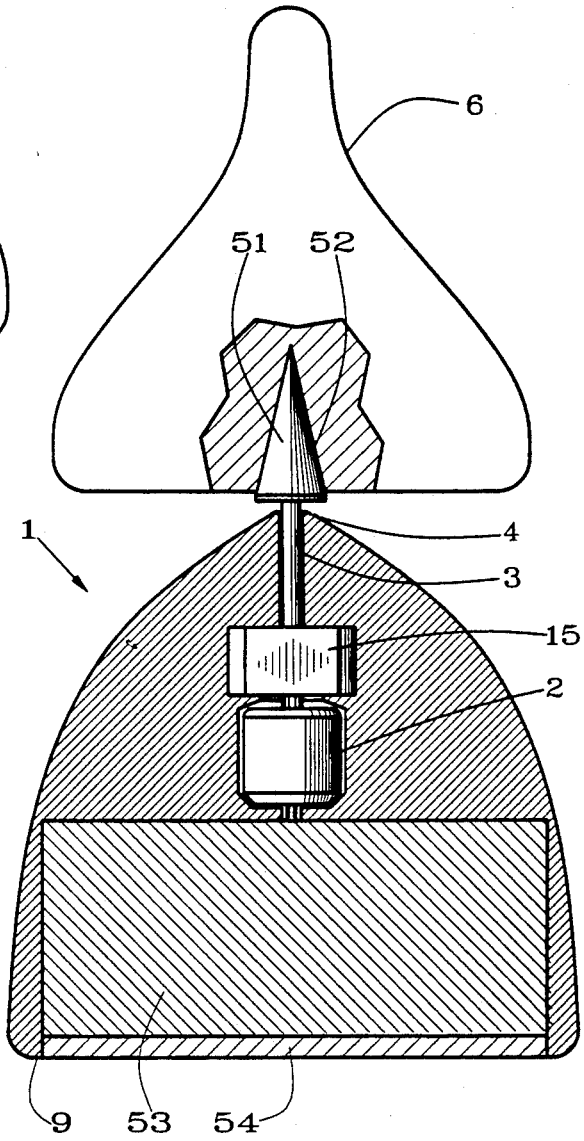
FIG.22

ORNAMENT AND DISPLAY ROTATOR

BACKGROUND OF THE INVENTION

I. Field of the Invention

The present invention relates generally to the field of miniature rotators with which a miniature motor can be employed to rotate ornaments and displays such as Christmas tree ornaments. advertising displays, furniture items and toys.

II. Description of the Prior Art

U.S. Pat. No. 4,980,608 described a miniature electrical motor for rotating Christmas tree ornaments and other small items. It was only a motor, however, not a stand or a base on which a small motor could be positioned for rotating items attached to a stand or a base. That patent taught a hook system for suspending the motor from a Christmas tree or other structure. It also taught a hook for suspending items to be rotated from the motor. But this was of very limited utility. This prior invention was not a machine or tool which used a miniature motor for rotating small objects. The present invention, however, is a machine or tool which uses the miniature motor of that patent, or other motors, to rotate a wide variety of objects with convenience and efficiency for many use conditions.

SUMMARY OF THE INVENTION

In accordance with the present invention, it is contemplated that one object of this invention is to provide a Christmas tree ornament rotator which can be positioned on top of a Christmas tree with a selection of alternate attachment means for different sizes and shapes of Christmas trees and for different construction of artificial Christmas trees.

Another object is to provide an ornament and display rotator which can be positioned conveniently, sturdily, reliably and safely on a wide variety of structures.

Another object is to provide a means for attaching a wide variety of ornaments and other objects to an ornament and display rotator.

This invention accomplishes the above and other objectives with an ornament and display rotator having a reduction geared rotational shaft of a miniature motor extended from an apex of a cone-shaped housing. Ornament and display attachment means adaptable to a wide variety of ornaments and other objects for rotation are provided on the rotational shaft. Linear bearing means also is provided as needed for vertical load bearing relationship between the apex of the cone and the rotational shaft. Adaptable means for attachment of the base of the cone-shaped housing to a wide variety of objects and structures is provided. The cone-shaped housing is adaptable to stored energy motors and gas powered motors in addition to small electrical motors.

Other objects, advantages and capabilities of the invention will become apparent from the following description taken in conjunction with the accompanying drawings showing preferred embodiments of the invention.

BRIEF DESCRIPTION OF THE DRAWINGS

FIG. 1 is a cross-section view of this invention of a Christmas tree ornament and display rotator with a miniature electrical motor having a wire extended for plugging into a typical light string of Christmas tree lights;

FIG. 2 is a top view of a cross type of ornament holder;

FIG. 3 is a cutaway sectional view of conventional Christmas tree clip with a cylindrical container into which a stem of this invention is fittable for holding it on top of a Christmas tree;

FIG. 21 is a cutaway side view of an embodiment having a cone-shaped ornament holder that is fittable into a matching cone-shaped ornament bay in ornaments and displays for rotation; and FIG. 22 is a cross-sectional view of an embodiment having a relatively large diameter and optionally heavy bottom section in which stored energy items can be placed for powering the rotational motor.

DESCRIPTION OF THE PREFERRED EMBODIMENT

Figure 4:
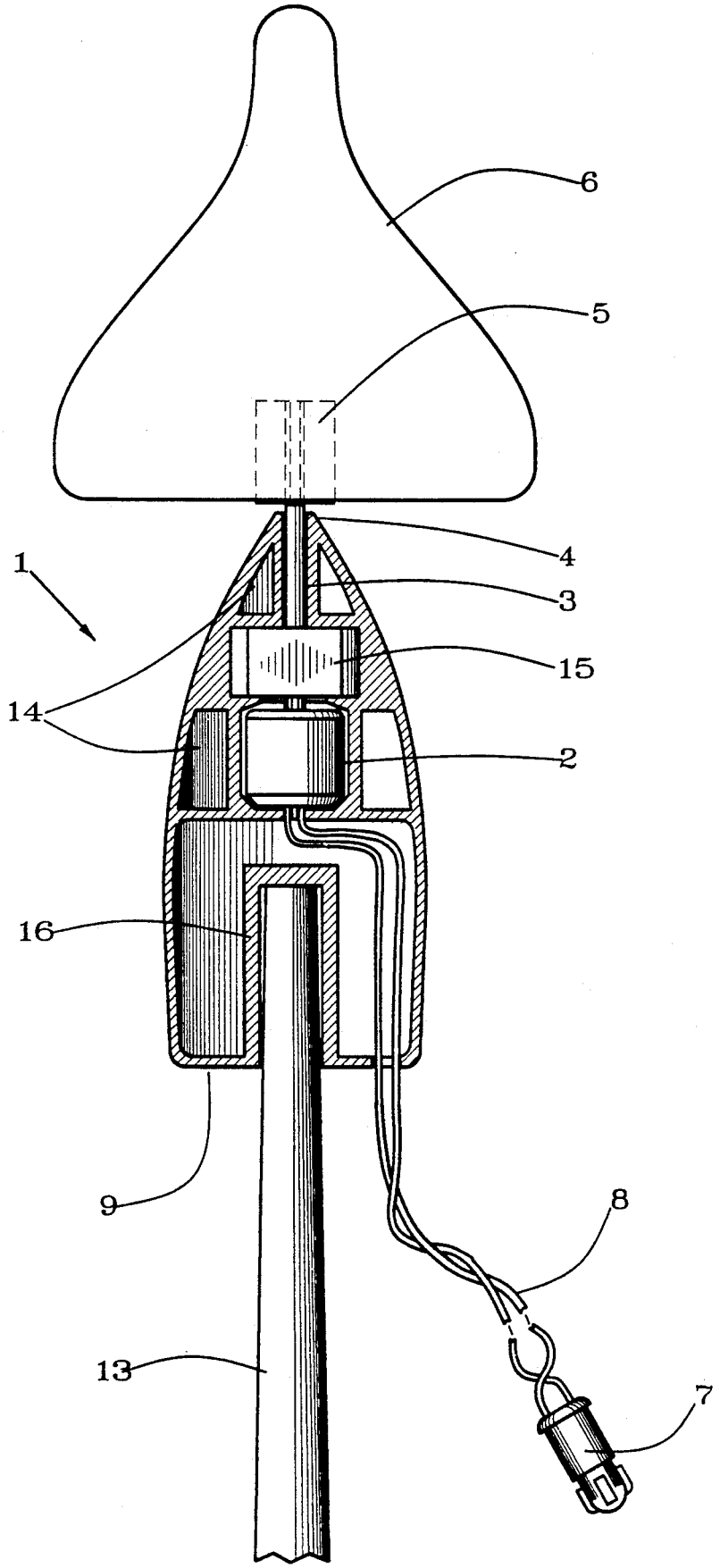
FIG. 4 is a cross-sectional view of an embodiment with an internal receptacle for insertion of a Christmas tree top and having a figurative Christmas tree ornament mounted on a cross type of ornament holder.

Referring to the drawings wherein like reference numerals designate corresponding parts throughout the several figures, a cone-shaped structure 1 has a rotational motor 2 with a geared rotational shaft 3 extended through an apex 4 of the cone-shaped structure 1. The cone 1 can have either a circular, a rectangular or other cross-sectional shape. A cross-shaped ornament holder 5 is positional on an extended end of the geared rotational shaft 3 as a means for attaching an ornament or display 6, shown in FIGS. 4, 5, 8, 10, 21 and 22, to be rotated by this ornament and display rotator. The rotational motor 2 can be a miniature motor powered by electrical current from a Christmas tree light plug 7 and conveyed to the rotational motor by Christmas tree light wire 8. At a cone base 9 on a vertical bottom of the cone-shaped structure 1 can be a cone attachment shaft 10 which is insertable into a clip cylinder 11 of a conventional Christmas tree clip 12. Typically, the Christmas tree clip 12 is fastened to a Christmas tree top 13. Hollow spaces 14 with selectively angular configuration can be provided for structural integrity with light weight for use on relatively small and flexible Christmas tree tops 13. The geared rotational motor 2 can be provided with gearing 15 which can be decreased speed gearing for some types of power, increased speed gearing for other types of power to be described and reverse gearing in accordance with various planned control means. Rotational direction of the rotational motor 2 is also reversible. The rotational motor 2 shown in FIGS. 1, 4, 5, 8, 17, 21 and 22 is electrical. Different types of motors are shown as foreseeable options in FIGS. 18 and 19.

Referring to FIG. 4, a Christmas tree ornament or display 6 can be provided with an attachment orifice into which the cross-shaped ornament holder 5 can be inserted for holding it. The cone base 9 can be provided alternatively with a cylindrical cone attachment bay 16 into which a Christmas tree top 13 is insertional. The Christmas tree light wire 8 is shown in sections joined by broken lines to indicate any length or form of electrical wiring similar to Christmas tree light wire used.

Figure 5:
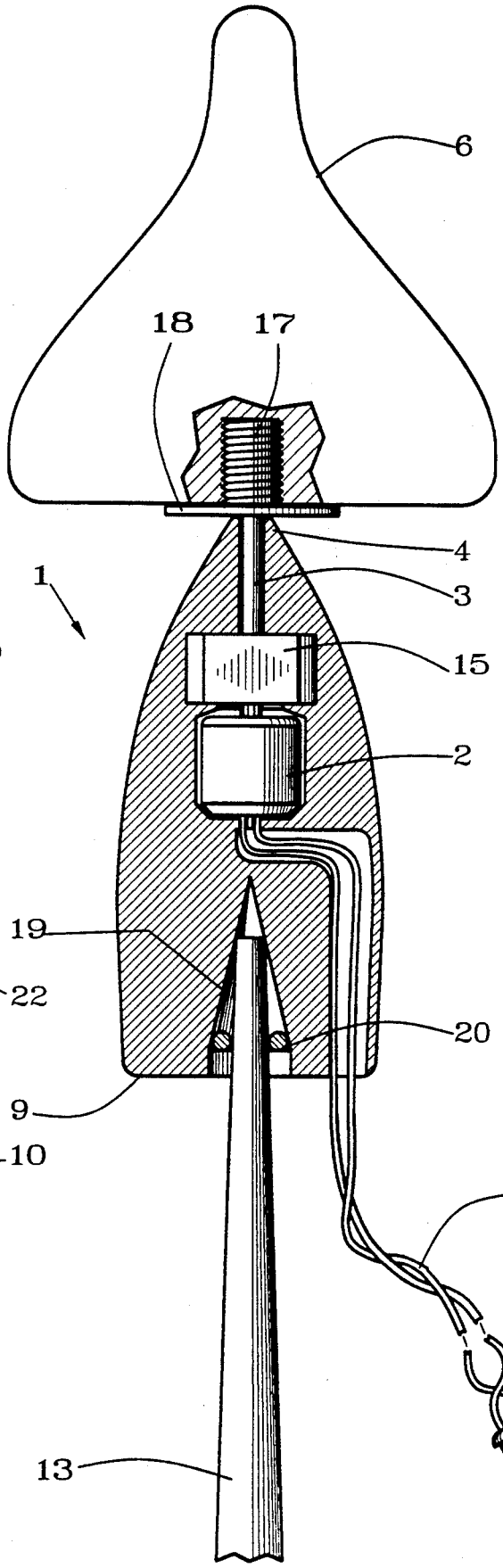
FIG. 5 is a cross-sectional view of an embodiment with a cone-shaped internal receptacle for insertion of a Christmas tree top that is held steady with a rubber O-ring. This embodiment features a threaded shaft on a rotary table for mounting ornaments and displays.
Figure 6:
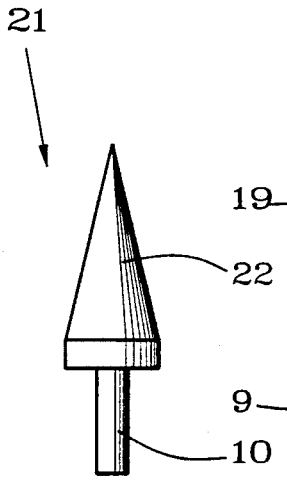
FIG. 6 is a double attachment plug that can be inserted into the cone-shaped internal receptacle of the FIG. 5 embodiment for providing either internal or external mounting to a Christmas tree or other cylindrical projection.
Figure 7:
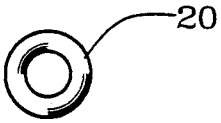
FIG. 7 is a top view of a rubber O-ring shown holding a Christmas tree top steady in the FIG. 5 illustration.

Referring to FIGS. 5–7, a threaded ornament shaft 17 can be threaded into an ornament or display 6 as an alternative to the cross-shaped ornament holder 5. A rotary table 18 can be provided as a base on which an ornament or display 6 is positional for rotation. A cone-shaped attachment bay 19 can be provided in the cone base 9 for insertion of a Christmas tree top 13 or other elongated structure onto which this ornament and display rotator can be mounted. A resilient O-ring 20 can be employed to center position the Christmas tree top 13 or other elongated object in the cone-shaped ornament bay 19 near the cone base 9. A terminal end of the Christmas tree top 13 or other elongated object can be center positioned by geometrical structure of a top portion of the cone-shaped ornament bay 19. Center positioning of the Christmas tree top 13 at both ends of the cone-shaped ornament bay 19 holds it rigidly. This is an internal receptacle means for attachment of this rotator to an elongated object such as a Christmas tree. A double attachment plug 21 is provided with a coned end 22 that is insertional in the cone-shaped ornament bay 19 when it is desirable to use a cone attachment shaft 10 on an opposite end of the double attachment plug as illustrated in FIGS. 8, 18, 19, 20 and 21.

Figure 8:
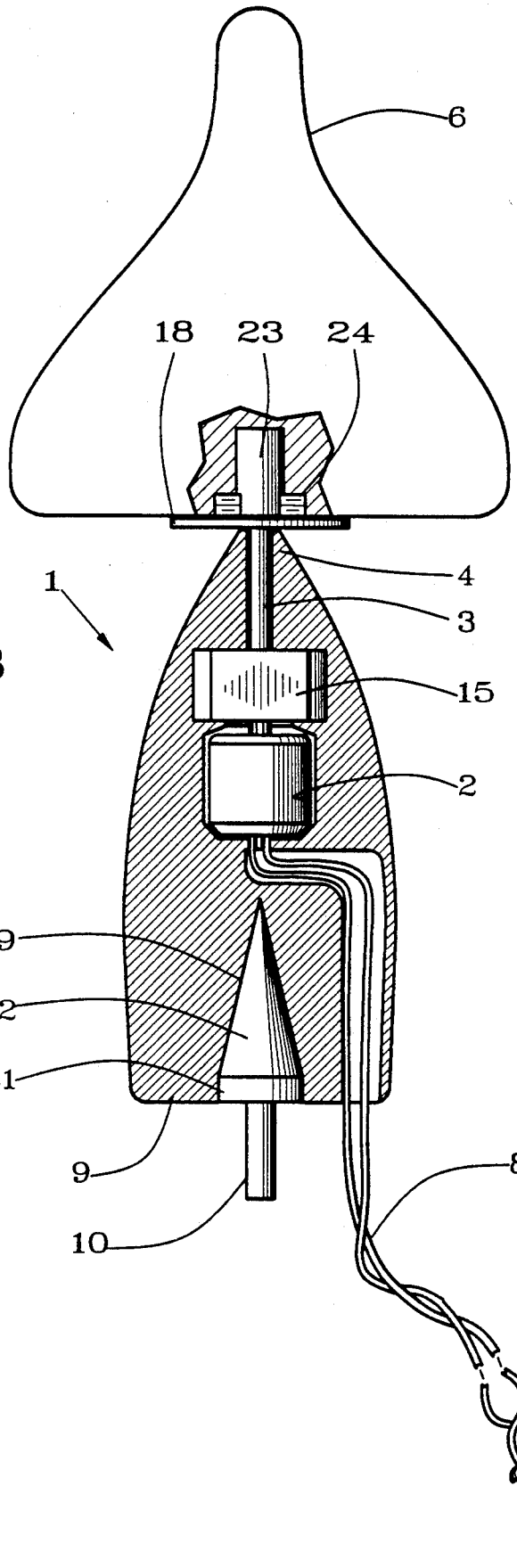
FIG. 8 is a cross-sectional view of the invention with the double attachment plug of FIG. 6 inserted. It features a cylindrical ornament holder on top of a rotary table having one or more key members for preventing transverse rotation of an ornament or display positioned on the cylindrical ornament holder.
Figure 9:
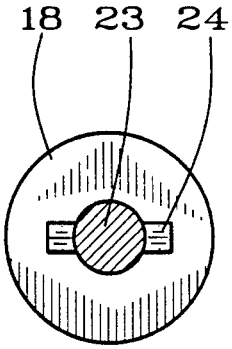
FIG. 9 is a top view of the cylinder, rotary table and keys shown in FIG. 8.
Figure 10:
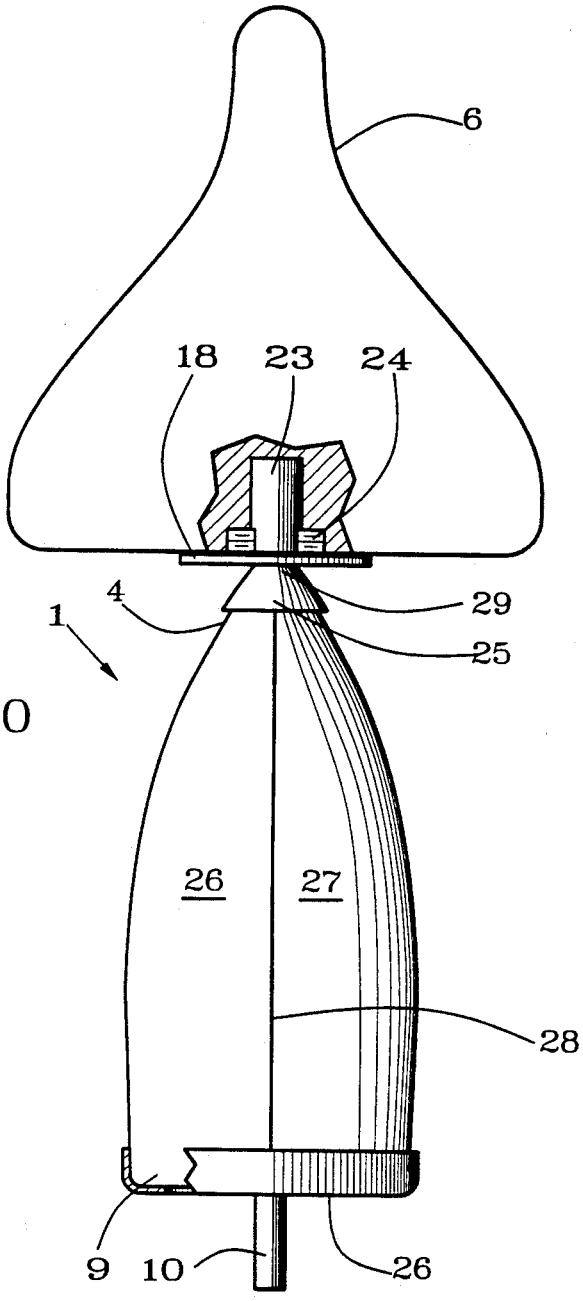
FIG. 10 is an elevation view showing a center line of halves of the cone-shaped rotator held together optionally by a coned cap and a walled bottom ring. The coned cap functions also as a bearing surface for an illustrated rotary table.
Figure 11:
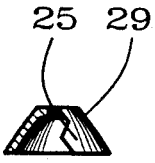
FIG. 11 is a cutaway side view of the coned cap shown in FIG. 10.
Figure 12:
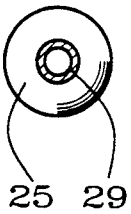
FIG. 12 is a top view of the coned cap shown in FIG. 10.
Figure 13:
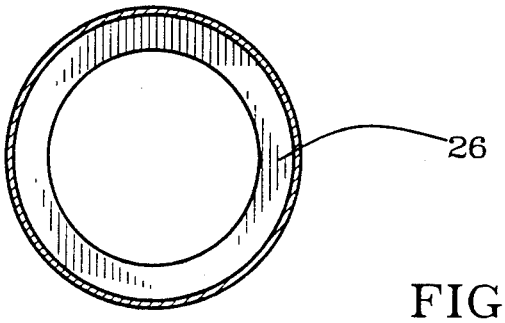
FIG. 13 is a top view of the walled bottom ring shown in FIG. 10.

Referring to FIGS. 8 and 9, a cylindrical ornament shaft 23 on the rotary table 18 can be inserted into a matching orifice in the ornament or display 6. Transverse rotation or rotational travel can be arrested by one or more anchor teeth 24 on the rotary table 18. The double attachment plug 21 is shown to be inserted into the cone-shaped ornament bay in order to position the cone attachment shaft 10 for insertion into a clip cylinder 11 of a Christmas tree clip 12 as illustrated in FIG. 1. This allows two methods of attachment with the cone-shaped ornament bay 19.

Referring to FIGS. 10–13, a coned cap 25 is positional on the apex 4 of the cone-shaped structure 1 and a walled bottom ring 26 is positional on the cone base 9 as a means for holding half shell 26 and an opposite half shell 27 together at a peripheral joining line 28. In addition, coned cap apex 29 can be used as a bearing surface for rotational contact with the rotary table 18. This allows ease and reliability of assembly. It is an alternative to gluing the two half shells 26 and 27 together.

Figure 14:
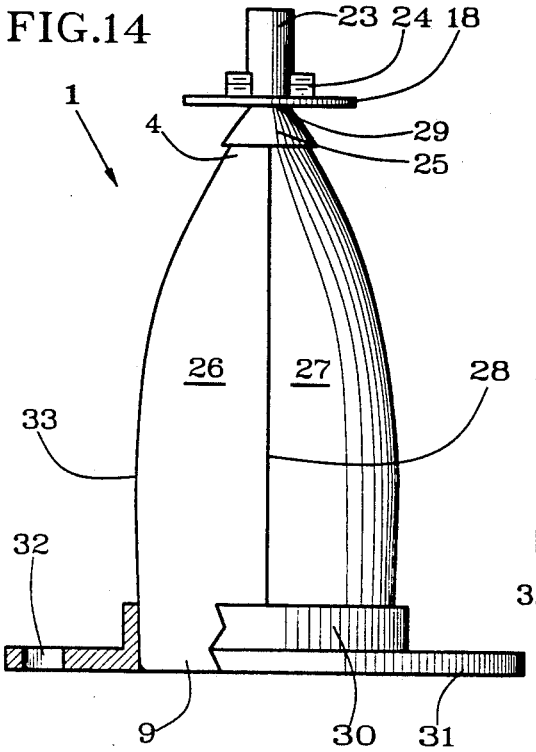
FIG. 14 is an elevation view of an embodiment having a circumferential ring and attachment flange for attachment to surfaces such as tables and display shelves.
Figure 15:
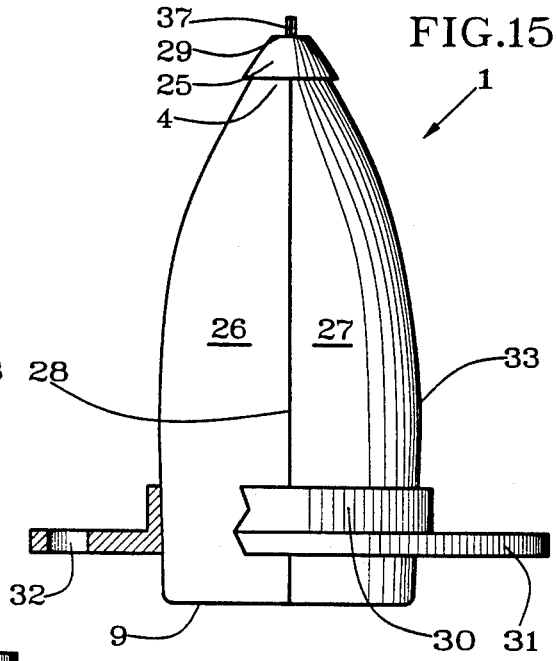
FIG. 15 is an elevation view of an embodiment having a circumferential ring and attachment flange for sinking the rotator below surfaces. It features also a rotary shaft having an attachment extension onto which other rotary shafts and rotary tables can be fitted.

Referring to FIGS. 14 and 15, bases 9 of half shells 26 and 27 which comprise cone-shaped structure 1 can be held together alternatively by a circumferential ring 30 which can have an attachment flange 31 with fastener orifices 32 for attachment to flat surfaces. In FIG. 15, the circumferential ring 30 is shown in an optional position further up the cone-shaped structure 1 from the cone base 9 but still below a major diameter 33 of the cone-shaped structure 1. The major diameter 33 prevents the cone-shaped structure 1 from slipping out of the circumferential ring 30. The circumferential ring 30 can be adjustable in circumferential length by such means as resiliency or clamp-type fasteners which are not shown. Optionally, the circumferential ring 30 can be made of rigid material and fitted to an outside diameter of the cone-shaped structure 1 at a position below the major diameter 33.

Figure 16:
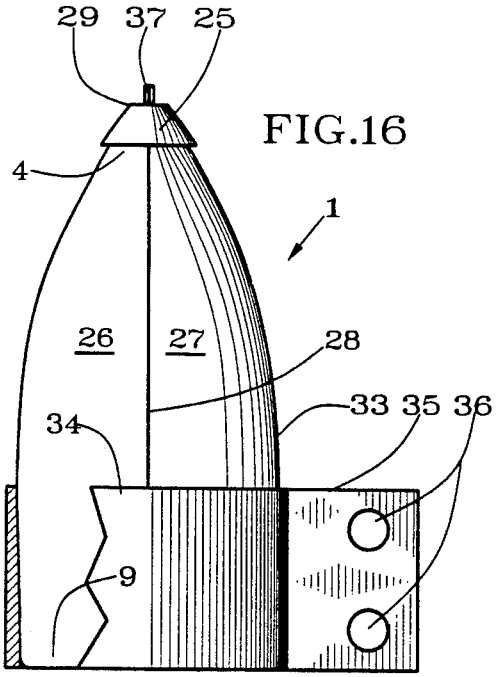
FIG. 16 is an embodiment having a side mount with a cylindrical attachment to a bottom portion of the cone.

Referring to FIG. 16, a side attachment circumferential ring 34 can be provided with side attachment member 35 to provide side attachment in addition to holding half shells 26 and 27 together below major diameter 33 the same as circumferential ring 30. Fastener orifices 36 can be provided in the side attachment member 35.

Shown also in FIGS. 15 and 16 is a spline end 37 of the geared rotational shaft 3. It can be employed for connection to ornament attachment means such as rotary table 18, threaded ornament shaft 17, cylindrical ornament shaft 23 and a coned ornament shaft described later in relation to FIGS. 21 and 22. This spline end 37 of shaft 3 is shown also in FIGS. 18–20.

Figure 17:
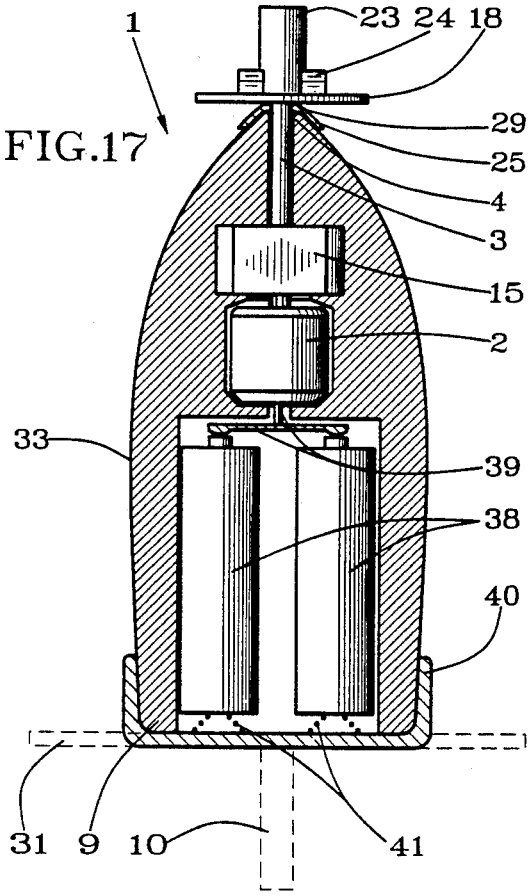
FIG. 17 is a cross-sectional view of an embodiment having a battery powered electrical motor and conventional "AA" batteries inside of a bottom portion of the cone-shaped structure of the rotator. Optional surface mounting or cylindrical mounting can be provided on a walled bottom ring.

Referring to FIG. 17, one or more batteries 38 can be employed to supply electrical current through battery current lines 39 in place of the Christmas tree wiring 7 and 8 shown in FIG. 1. A cluster of four or five size AA batteries 38 can fit into a cone-shaped structure 1 just slightly larger than would be employed typically for using Christmas tree light wiring 7 and 8. The batteries 38 can be held in by a battery cone lid 40 that can be friction fit or screwed onto the base 9 of the cone-shaped structure 1. Attachment flange 31 can be provided on the battery cone lid 40 the same as on circumferential ring 30. A cone attachment shaft 10 also can be attached to the battery cone lid 40. Battery positioning springs 41 can be employed to provide electrical contact of the batteries 38 with battery current lines 39.

Figure 18:
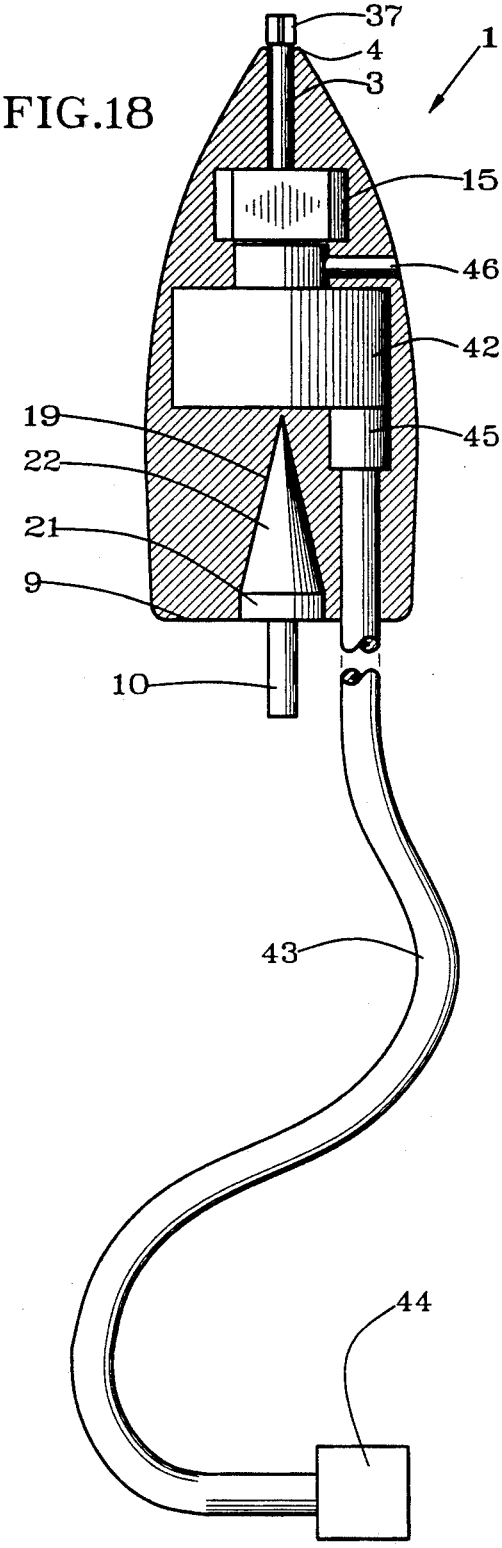
FIG. 18 is a cross-sectional view of an embodiment having a gas powered motor and a source of gas pressure such as an air compressor.

Referring to FIG. 18, a gas pressure motor 42 can be provided as an option to electrical motor 2 of FIGS. 1, 4, 5, 8, 17, 21 and 22. A compressed air motor is a typical gas pressure motor 42. Compressed air can be supplied through pressure lines 43 from a compressor or pump 44. Alternatively, compressed gas such as compressed air can be stored within the cone-shaped structure 1 at a position in which a connector 45 is shown. Spent gas would be exhausted through exhaust orifice 46.

Figure 19:
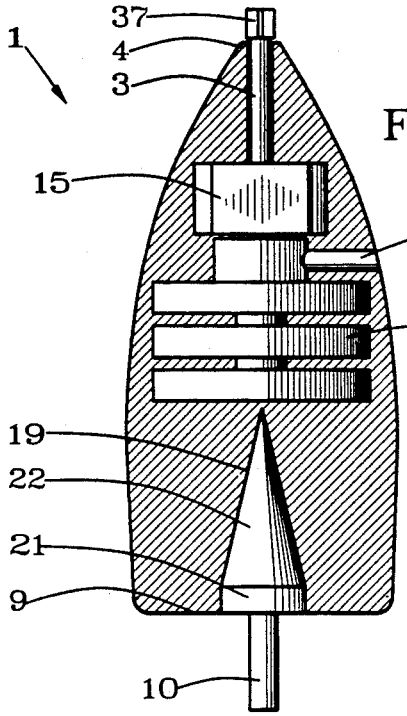
FIG. 19 is a cross-sectional view of an embodiment having a clock spring type of stored energy motor with a plurality of consecutively operated coil springs.

Referring to FIG. 19, a stored energy spring motor 47 with clock-type springs can be employed for some use conditions. It can be wound through a key orifice 48. This can be particularly advantageous when a series of springs are employed consecutively in ways not described in relation to this particular invention. When spring stored energy is employed, the gearing 15 is speed increasing rather than speed decreasing as for other types of rotational motors 2 and 42. For some applications, a spring motor 42 can be made to provide power for most of a Christmas Season with only one winding.

Figure 20:
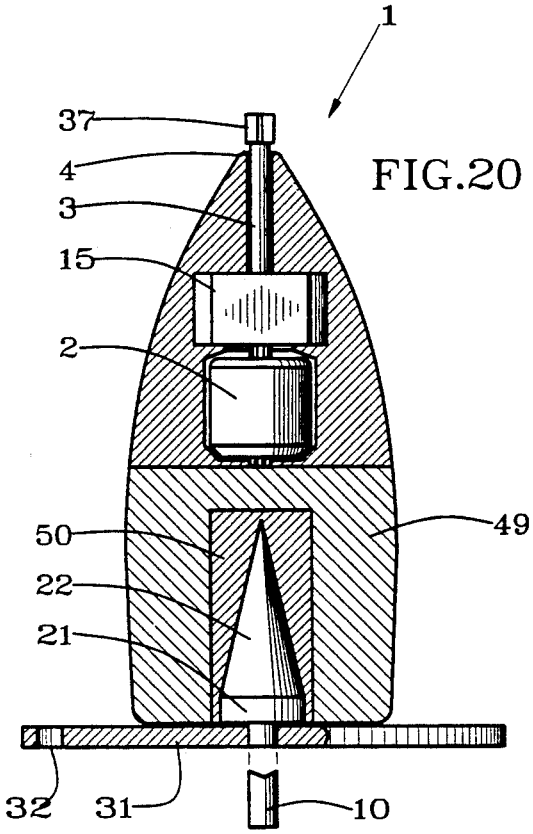
FIG. 20 is a cutaway side view of an embodiment having a solar cell powered electrical motor and an optional base plate attached to an attachment shaft of a double attachment plug.

Referring to FIG. 20, solar energy generator 49 also is a foreseeable source of energy for this invention. With this source of energy as with others, the double attachment plug 21 can be employed with an optional adaptor cylinder 50. Attachment flange 31 with fastener orifices 32 can be employed in the same working relationship as described in relation to FIGS. 14, 15 and 17.

Referring to FIG. 21, a cone-shaped ornament holder 51 can be inserted into coned orifices 52 in ornaments or displays 6 to secure them for rotation. This is a particularly convenient means for attaching ornaments for a wide variety of use conditions.

Referring to FIG. 22, a cone-shaped structure 1 can have a broad cone base 9. This makes it particularly useful on horizontal surfaces such as tables and commercial display shelves. For this type of application, a stored energy unit 53 can be inserted. Stored energy in the form of a battery could be made to last a full Christmas Season for rotating relatively large or heavy ornaments or displays. A bottom surface 54 can be magnetic or non-slip for some toy applications in various sizes of this embodiment of the invention.

Various modifications may be made of the invention without departing from the scope thereof and it is desired, therefore, that only such limitations shall be placed thereon as are imposed by the prior art and which are set forth in the appended claims.

What is claimed is:

1. An ornament and display rotator having:

a cone-shaped structure comprised of two linear half shell cones into which internal components of the ornament and display rotator are positioned, a means for holding the two linear half shell cones together in matching alignment, a rotational motor positioned inside of the cone-shaped structure, a geared rotational shaft extended axially from the rotational motor through a vertical apex of the cone-shaped structure, a means for attaching items to be rotated onto the geared rotational shaft, a cone base on a vertical bottom of the cone-shaped structure, and a means for attaching the cone-shaped structure to other structures on which the ornament and display rotator is positioned for rotating select ornament and display items.

2. An ornament and display rotator as claimed in claim 1, wherein an interior framework of the cone-shaped structure is comprised of compartment walls surrounding compartments which house the internal components of the ornament and display rotator.

3. An ornament and display rotator as claimed in claim 2, wherein the compartment walls are separated from cone walls of the coneshaped structure by selectively angled spaces which provide structural integrity with low weight for use on fragile and easily bendable structures.

4. An ornament and display rotator as claimed in claim 1 and further comprising:

a mounting shaft of predetermined size and shape for mounting the rotator to a fixed object, the mounting shaft extended vertically downward from the base of the cone-shaped structure.

5. An ornament and display rotator as claimed in claim 1, wherein the rotational motor is a miniature electrical motor designed to be powered electrically by electrical output from a conventional Christmas tree light socket and further comprising:

electrical wires in electrical communication between the rotational motor and an electrical plug insertable into a Christmas tree light plug.

6. An ornament and display rotator as claimed in claim 1, wherein the rotational motor is a miniature electrical motor designed to be powered by at least one battery positional in the cone-shaped structure and further comprising:

electrical communication means in electrical communication between the rotational motor and the battery.

7. An ornament and display rotator as claimed in claim 1, wherein the rotational motor is a miniature spring power stored energy motor designed to be powered by a coil spring positional in the cone-shaped structure and further comprising:

rotational gearing means in gear drive relationship between the rotational motor and the coil spring.

8. An ornament and display rotator as claimed in claim 1, wherein the rotational motor is a miniature gas powered motor designed to be powered by compressed gas and further comprising:

a compressed gas supply means in fluid communication with the miniature gas powered motor.

9. An ornament and display rotator as claimed in claim 8 wherein the compressed gas supply means is a pressure tank positional in the cone-shaped structure.

10. An ornament and display rotator as claimed in claim 8, wherein the compressed gas supply means is a remote pressure tank in fluid communication with an air compressor.

11. An ornament and display rotator as claimed in claim 1, wherein the means for attaching items to be rotated onto the geared rotational shaft is an attachable extension of the geared rotational shaft having a cross-shaped cross section which is fittable into attachment orifices in ornaments and displays for rotation.

12. An ornament and display rotator as claimed in claim 1, wherein the means for attaching items to be rotated onto the geared rotational shaft is an attachable extension of the geared rotational shaft having a cylindrical cross section which is fittable into attachment orifices in ornaments and displays for rotation and further comprising:

a rotary table at a center of which is extended the attachable extension of the geared rotational shaft proximate a position of attachment of the attachable extension of the geared rotational shaft to the geared rotational shaft, the rotary table providing a platform on which items to be rotated are positional at an outside periphery of the attachable extension of the geared rotational shaft, and at least one anchor key extended vertically from a top surface of the rotary table to resist transverse rotational travel of items positioned on the rotary table and having the attachable extension of the geared rotational shaft inserted in an attachment bay in the items positioned on the rotary table for rotation.

13. An ornament and display rotator as claimed in claim 12, wherein the attachable extension of the geared rotational shaft is threaded on its outside diameter to match threading on inside diameters of items positional on the geared rotational shaft for rotation.

14. An ornament and display rotator as claimed in claim 1, wherein a bottom surface of a rotary table on the geared rotational shaft is in slidable contact with the apex of the cone-shaped structure such that the apex of the cone-shaped structure provides a linear load bearing relationship to the rotary table to support weight of the rotary table and weight of items positioned on the rotary table without transmitting such weights to the geared rotational shaft and to gear and motor components in rotational drive relationship to the geared rotational shaft.

15. An ornament and display rotator as claimed in claim 14, and further comprising:

a bearing cap positional on the apex of the cone-shaped structure at an outside periphery of the geared rotational shaft, wherein the bottom surface of the rotary table being in slidable contact with an apex of the bearing cap such that the apex of the bearing cap provides a linear load bearing relationship to the rotary table to transmit support of weight of the rotary table and weight of items positioned on the rotary table to the cone-shaped structure without transmitting such weights to the geared rotational shaft and to gear and motor components in rotational drive relationship to the geared rotational shaft.

16. An ornament and display rotator as claimed in claim 1, wherein the means for attaching the cone-shaped structure to other structures comprising:

a rotator attachment bay extended axially from the cone base for insertion of projections on which the ornament and display rotator is positioned.

17. An ornament and display rotator as claimed in claim 1, wherein the means for attaching the cone-shaped structure to other structures comprising:

a rotator attachment base attachable to an outside periphery of the cone-shaped structure at select positions vertically below a maximum diameter periphery of the cone-shaped structure.

18. An ornament and display rotator as claimed in claim 17, wherein the rotator attachment base is attachable to the outside periphery of the cone-shaped structure by means of a circumferential strap attached to a rotator attachment table, the circumferential strap having circumferential length adjustment means positional snugly in frictional grasp relationship to the outside periphery of the cone-shaped structure.

19. An ornament and display rotator as claimed in claim 18, wherein the cone-shaped structure has a major diameter outside periphery at an axial position below which is a selectively tapered smaller diameter of the cone-shaped structure such that upward travel of the circumferential length adjustment means can be arrested to prevent the cone-shaped structure from slipping downward and out of the circumferential strap.

20. An ornament and display rotator as claimed in claim 17 and further comprising:

fastener orifices in the rotator attachment base.

21. An ornament and display rotator as claimed in claim 1 and further comprising:

a rotator side fastener attachable to the outside periphery of the cone-shaped structure by means of a circumferential strap having circumferential length adjustment means positional snugly in frictional grasp relationship to the outside periphery of the cone-shaped structure.

22. An ornament and display rotator as claimed in claim 21, wherein the cone-shaped structure has a major diameter outside periphery at an axial position below which is a selectively tapered smaller diameter of the cone-shaped structure such that upward travel of the circumferential length adjustment means can be arrested to prevent the cone-shaped structure from slipping downward and out of the circumferential strap.

23. An ornament and display rotator as claimed in claim 1, wherein the rotational motor is a miniature electrical motor designed to be powered by electrical current from a solar cell and further comprising:

a solar cell positioned in the cone-shaped structure, and electrical lines in electrical communication between the solar cell and the miniature electrical motor.

24. An ornament and display rotator as claimed in claim 1, wherein the means for attaching items to be rotated onto the geared rotational shaft is a cone-shaped shaft insertional into a matching cone-shaped attachment bay in ornaments and displays for rotation.

25. An ornament and display rotator as claimed in claim 1, wherein the means for holding the two linear half shell cones ether in matching alignment is adhesive material positioned on mating surfaces of the two linear half shell cones.

26. An ornament and display rotator as claimed in claim 25, wherein the means for holding the two linear half shell cones together in matching alignment is a bearing cap positioned on a top outside periphery of each of the two linear half shell cones and a circumferential member positioned on a bottom outside periphery when the two linear half shell cones are in matching surface to surface relationship.

27. A ornament and display rotator having:

a cone-shaped structure, a rotational motor positioned inside of the cone-shaped structure, a geared rotational shaft extended axially from the rotational motor through a vertical apex of the cone-shaped structure, a means for attaching items to be rotated onto the geared rotational shaft, a cone base on a vertical bottom of the cone-shaped structure, a means for attaching the cone-shaped structure to other structures on which the ornament and display rotator is positioned for rotating select ornament and display items, and wherein the means for attaching the cone-shaped structure to other structures on which the ornament and display rotator is positional is a cone-shaped bay in the cone base in the bottom of the coneshaped structure for rigidly center positioning a terminal end of an elongated object therein and a spacer positional circumferentially between an outside periphery of the elongated object and an inside periphery of the cone-shaped bay at a position selectively near an entrance to the cone-shaped bay for holding the elongated object rigidly near the entrance to the coneshaped bay.

28. An ornament and display rotator as claimed in claim 27, wherein the spacer is an O-ring.

29. An ornament and display rotator as claimed in claim 27 and further comprising:

a double attachment plug having a cone-shaped end fittable into the cone-shaped bay on one end of the double attachment plug and an attachment shaft on an opposite end of the double attachment plug.

30. An ornament and display rotator as claimed in claim 29 and further comprising:

an attachment base plate positional on the attachment shaft.

31. An ornament and display rotator having:

a cone-shaped structure, a rotational motor positioned inside of the cone-shaped structure, a geared rotational shaft extended axially from the rotational motor through a vertical apex of the cone-shaped structure, a means for attaching items to be rotated onto the geared rotational shaft, a cone base on a vertical bottom of the cone-shaped structure, a means for attaching the cone-shaped structure to other structures on which the ornament and display rotator is positioned for rotating select ornament and display items, and wherein a bottom surface of the cone-shaped structure is magnetic for adherence to metallic surfaces as the means for attaching the coneshaped structure to other structures on which the ornament and display rotator is positioned for rotating select ornament and display items.

* * * * *